US009345332B2

(12) United States Patent
Kieryllo et al.

(10) Patent No.: US 9,345,332 B2
(45) Date of Patent: May 24, 2016

(54) DUAL FUNCTIONAL CHAIR

(71) Applicant: HUMAN PLUS S.C., Milanowek (PL)

(72) Inventors: Andrzej Kieryllo, Milanowek (PL); Mateusz Kieryllo, Milanowek (PL)

(73) Assignee: HUMAN PLUS S.C., Milanowek (PL)

( * ) Notice: Subject to any disclaimer, the term of this patent is extended or adjusted under 35 U.S.C. 154(b) by 0 days.

(21) Appl. No.: 14/378,696

(22) PCT Filed: Jan. 29, 2013

(86) PCT No.: PCT/IB2013/000114
§ 371 (c)(1),
(2) Date: Aug. 14, 2014

(87) PCT Pub. No.: WO2013/124718
PCT Pub. Date: Aug. 29, 2013

(65) Prior Publication Data

US 2015/0335159 A1 Nov. 26, 2015

(30) Foreign Application Priority Data

Feb. 21, 2012 (PL) ..... 398195

(51) Int. Cl.

| | |
|---|---|
| ***A47C 7/50*** | (2006.01) |
| ***A47B 91/00*** | (2006.01) |
| ***F16M 11/20*** | (2006.01) |
| ***A47C 7/02*** | (2006.01) |
| ***A47C 9/00*** | (2006.01) |

(52) U.S. Cl.
CPC ..... *A47C 7/024* (2013.01); *A47C 7/506* (2013.01); *A47C 9/005* (2013.01)

(58) Field of Classification Search
CPC ..... A47C 7/024; A47C 7/506; A47C 9/005
USPC ..... 297/423.1, 423.11, 423.12, 423.13, 297/423.28; 248/188.7
See application file for complete search history.

(56) References Cited

U.S. PATENT DOCUMENTS

| | | | | | |
|---|---|---|---|---|---|
| 3,053,496 | A * | 9/1962 | Van Leeuwen | A47C 9/02 | 248/188.7 |
| 4,765,684 | A * | 8/1988 | Kvalheim | A47C 13/00 | 297/423.13 X |
| 4,848,841 | A * | 7/1989 | Giselsson | A47C 9/005 | 297/423.13 X |
| 5,054,857 | A * | 10/1991 | Kvalheim | A47C 1/027 | 297/423.13 X |

(Continued)

FOREIGN PATENT DOCUMENTS

| | | |
|---|---|---|
| EP | 0570550 A1 | 11/1993 |
| PL | 64081 Y1 | 10/2008 |

(Continued)

OTHER PUBLICATIONS

International Search Report for App. No. PCT/IB2013/000114 filed Jan. 29, 2013.

*Primary Examiner* — Rodney B White
(74) *Attorney, Agent, or Firm* — Walker & Jocke

(57) ABSTRACT

A dual functional chair with a dividable seat may be used in a sitting and kneeling-sitting configuration. The seat includes a front part (1) that is convertible into a knee rest. The front part is operatively connected rotationally and slidably or rotationally only, to a movable front arm of a base of the seat, rotating on the axis of a rotational mechanism (3). The seat includes a rear part (4) having a variable angle of inclination, operatively connected via a rotational mechanism (5) to a rear arm (6) of the base of the seat.

19 Claims, 13 Drawing Sheets

(56) References Cited

U.S. PATENT DOCUMENTS

| | | | | |
|---|---|---|---|---|
| 5,536,067 | A * | 7/1996 | Pinto | A47C 9/005 297/423.13 X |
| 5,667,278 | A * | 9/1997 | Li | A47C 9/005 297/423.13 X |
| 5,782,534 | A * | 7/1998 | Desanta | A47C 9/005 297/423.13 X |
| 6,811,225 | B1 * | 11/2004 | Konya | A47C 9/005 297/423.13 X |
| 7,887,136 | B2 * | 2/2011 | Zoell | A47C 4/022 297/423.13 X |
| 2007/0063569 | A1 * | 3/2007 | Mays | A47C 9/005 297/423.12 |
| 2009/0140567 | A1 * | 6/2009 | Weiss | A47C 7/503 297/423.12 |
| 2011/0193383 | A1 | 8/2011 | Guissin et al. | |

FOREIGN PATENT DOCUMENTS

| | | |
|---|---|---|
| PL | 390736 | 4/2010 |
| PL | 216033 B1 | 2/2014 |
| WO | 8500275 A1 | 1/1985 |

* cited by examiner

Chair base

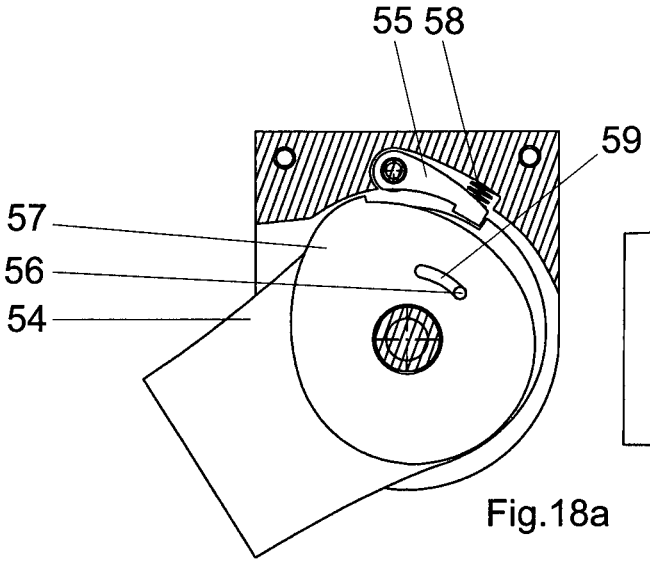
Fig.18a
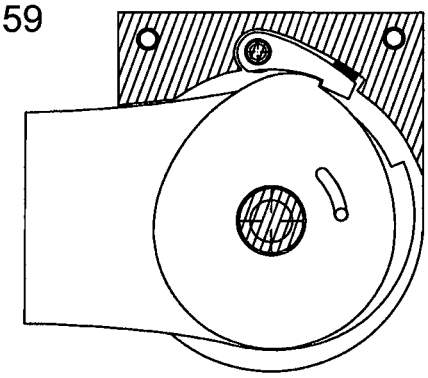
Fig.18b
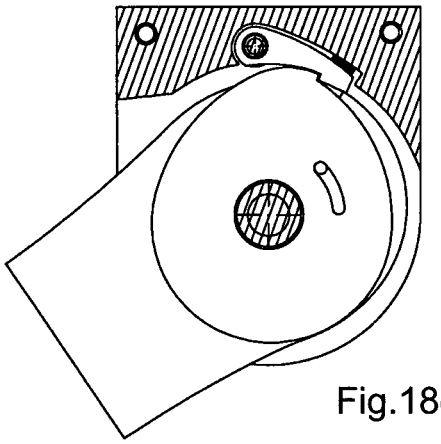
Fig.18c
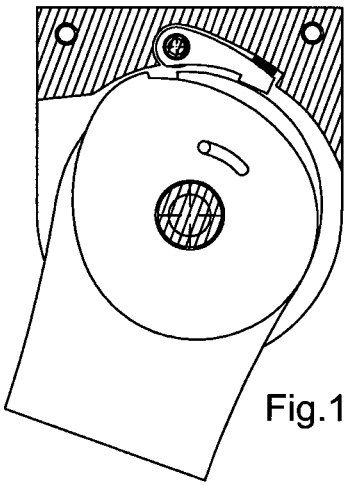
Fig.18d
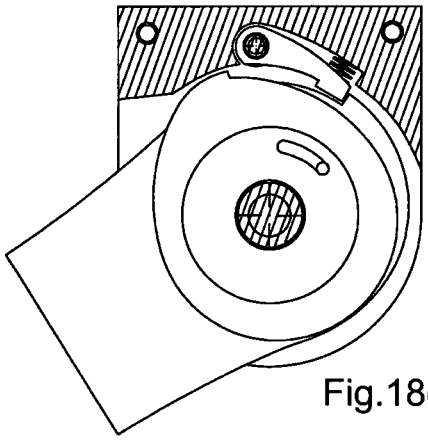
Fig.18e
Fig.18

DUAL FUNCTIONAL CHAIR

The object of the invention is a dual functional chair with a dividable seat, for sitting and kneeling, offering a possibility of changing a position and relieving the spinal column during a prolonged work in a sitting position.

Chairs of this type are disclosed in the Polish utility model No. 64081. A rehabilitation chair intended mostly for kneeling, without the backrest, built in the form of the letter X is known.

Also known are other solutions of a similar purpose, for example a convertible piece of furniture disclosed in the description of the Polish patent application No. P.390736 intended for sitting and kneeling, in which the two-piece set of knee rests is supported on arms mounted rotationally and with reclining ability in clasps of a cross-piece.

There are known other solutions of a similar purpose, as for example those disclosed in the European patent application No. EP 0 570 550, in which the seat, knee rest and backrest are suspended on an appropriate mechanism placed on the supporting column mounted on a base with wheels. These mechanisms are levers allowing for movement in space of usable parts of the chair, depending on the needs. In such a way the chair may be converted into the sitting, sitting-kneeling and similar configurations. Fixing of the position of the seat, knee rest and backrest is achieved by means of locking and backstopping mechanisms.

Furthermore, from the description of the Polish patent application No. P.387898 there are known pieces of furniture of a similar type. The described chair has a seat, a two-piece knee rest, a backrest and armrests. The knee rest set consists of two parts and each one of them may be moved to recline the knee rest and push it backward.

The essence of the invention consists in that the seat of the chair is dividable and its front part is convertible into a knee rest, the chair has a double arm seat support and its first one moving arm supports the front part of the seat convertible into a knee rest, while the second arm supports the rear part of the seat and the backrest, the chair having a base with three specifically formed arms and each one of the two rear arms is supported on two wheels while the front arm is supported on one wheel, whereby the base allows the user to place his feet comfortably under the seat while in a kneeling-sitting position.

The utilization of bevel gear mechanisms or transmissions based on cogged belts or chains, or else tie rods system in the chair structure results in that the chair automatically converts from the sitting configuration into the kneeling configuration by means of a spring action started after releasing the lock, whereas the conversion of the chair back into the sitting configuration is effected by means of the user weight pressing on the seat. These are semi-automatic versions of the chair. In event of attaching a drive in the form of an electrical motor and drive control to the transmission mechanisms, the conversion into both configurations is effected automatically. These are fully automatic versions.

Including in the chair structure a mechanism regulating the angle of inclination of the backrest with automatic correction of the angle during conversion causes that the angle of inclination of the backrest in relation to the vertical remains unchanged during the conversion of the chair and needs no correction.

Including in the basic version of the chair a lock mechanism with a latch blockade causes the seat to be locked in the kneeling configuration by a latch after being lifted, and a repeated lifting of the seat causes the release of the lock and automatic lowering of the seat into the sitting configuration.

The knee rest is also unlocked with one gentle upward movement after releasing the arm rotation lock. It is re-locked automatically after returning it to the initial position.

An advantageous effect of the invention is the integration of the knee rest in the seat, which makes the chair similar to a standard chair and causes the dual functional chair to be fully universal. Such a solution provides discretion to the users by not exposing the rehabilitative nature of the furniture, which allows for a wider use of the invention in offices and public space. The special structure of the base allows for comfortable placement of feet under the seat, which considerably increases the user's comfort.

An advantageous effect of the utilization of individual variants of transmission mechanisms or tie rods is the possibility of semi-automatic, and with the addition of an engine—fully automatic conversion of the chair with no need for the user to bow, which is especially significant for persons with spine problems.

An advantageous effect of the utilization of the mechanism regulating the angle of inclination of the backrest with automatic correction of the inclination angle is the ability of the backrest to remain in the position proper for the user after converting the chair without any need for manual correction.

An advantageous effect of the utilization of the rotation lock mechanism with a latch blockade in the basic, economic version of the chair is the facility of unlocking the seat and the knee rest from the sitting position into the kneeling position by their gentle lifting without the need to use any additional levers or locks.

The object of the invention in its embodiment has been illustrated in the drawing.

FIG. 18 illustrates the rotation mechanism with rotation lock and latch blockade in consecutive stages of action.

Figure 1:
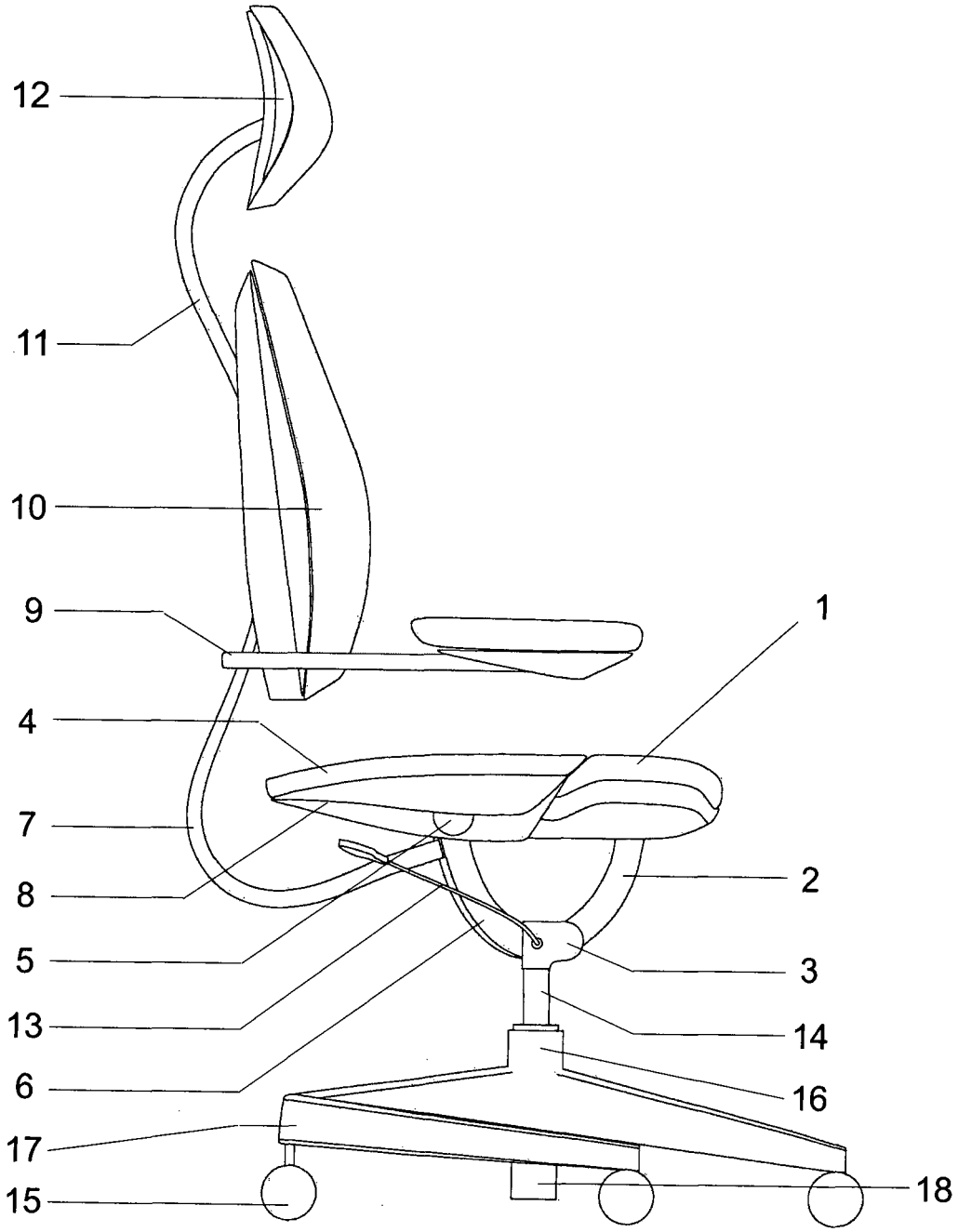
FIG. 1 illustrates the chair in the sitting configuration.
Figure 2:
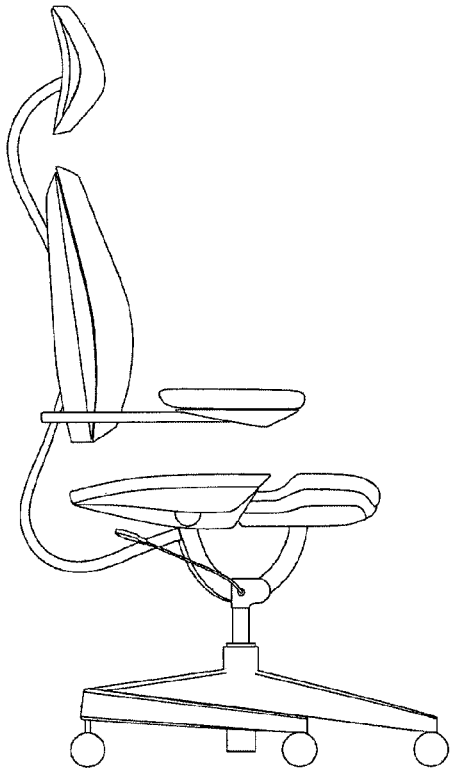
FIG. 2 illustrates the chair in the first stage of conversion.
Figure 3:
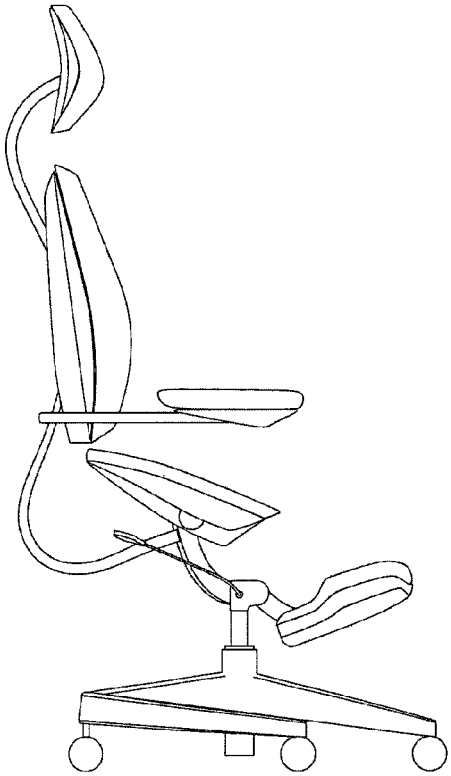
FIG. 3 illustrates the chair in the kneeling configuration.
Figure 4:
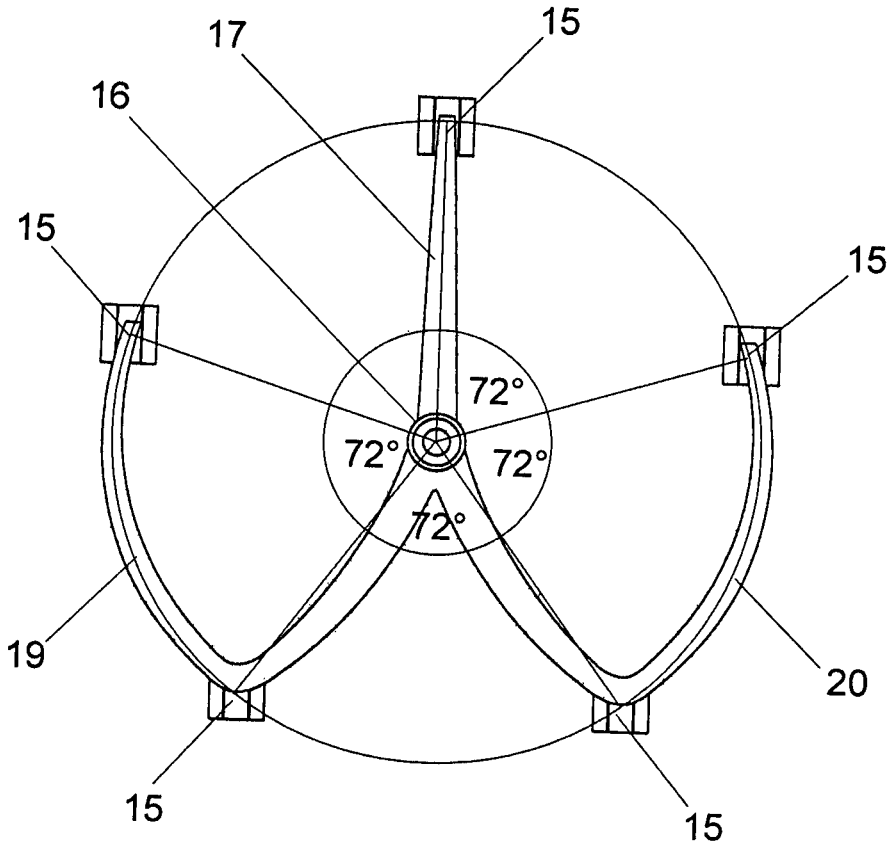
FIG. 4 is a top view of the base.
Figure 5:
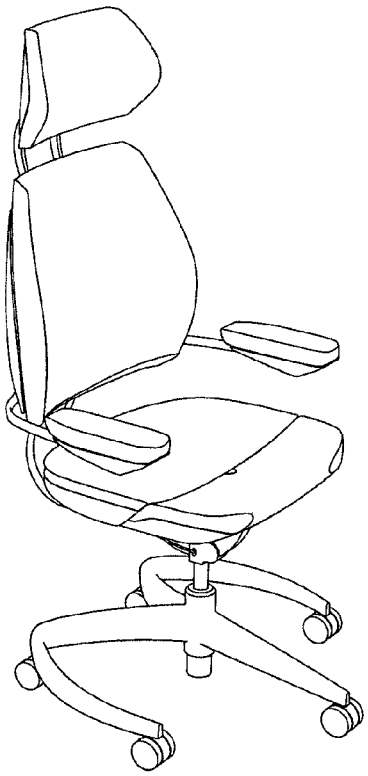
FIG. 5 is a perspective view of the chair in the sitting configuration.
Figure 6:
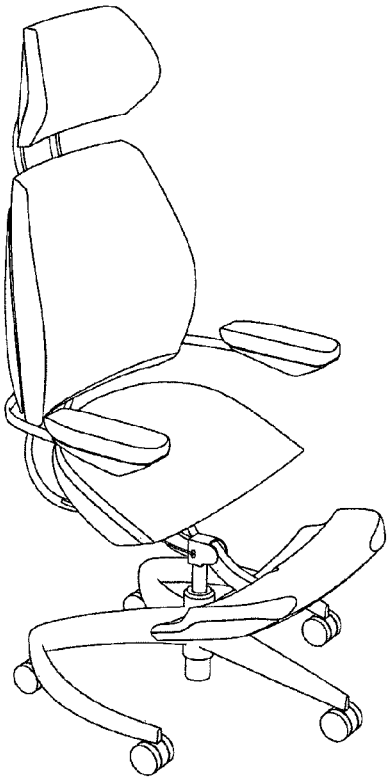
FIG. 6 is a perspective view of the chair in the kneeling configuration.

FIGS. 1-3 and FIGS. 5-6 illustrate the chair with a dividable seat consisting of a front part 1 of the seat convertible into a knee rest, and of a rear part 4 of a variable angle of inclination. A rear arm 6 of a seat base is mounted rotationally on a column 14, which arm is connected to a plate 8 supporting the rear part 4 of the seat by means of a rotational mechanism 5 with a rotation lock. A front arm 2 of the seat base is mounted to the lower part of the rear arm by means of a rotational mechanism 3 with rotation lock. The front part 1 of the seat is mounted to the upper part of the front arm 2 by means of a rotational and sliding mechanism with rotation limiter and allowing horizontal sliding movement (not shown), or by means of a rotational mechanism only with rotation lock (not shown either). A backrest support 7 supports a backrest 10 and a set of armrests 9. A headrest support 11 supporting a headrest 12 is mounted to the backrest. A column 14 is slipped into a sleeve 16 of a three-arm base (FIG. 4) supported on five wheels 15 arranged on a circle and spaced apart from each other of ca. 72°, whereby the front arm 17 is supported on one wheel and each one of the rear arms 19 and 20 is supported on two wheels. A mechanism 18 for regulating the height of the chair, released by means of a lever 13 is located in the sleeve 16.

In the semi-automatic version of the chair, with bevel gears (FIGS. 7-8), the movement of unfolding the chair is transmitted by means of bevel gears from the rear part 4 of the seat to the front part 1 of the seat, converting the latter part into a knee rest. The larger cogwheel of the bevel gear 21 is connected coaxially to the rear part .4 of the seat. The smaller cogwheel of the gear 21 is mounted on roller 22. The cogwheel of the bevel gear 23 is mounted on the opposite end of the roller 22. The second cogwheel of gear 23 is connected to and coaxial with the front arm 2. The cogwheel of the gear 24 is mounted on a mutual axis with the larger cogwheel of the gear 23. The cogwheel of gear 23 and the arm 2 are rotationally mounted on the axis and the cogwheel of gear 24 is connected to the axis being non-rotationally mounted in the casing. The second cogwheel of the gear 24 is mounted on roller 25, while on its opposite end the cogwheel of gear 26 is situated. The larger cogwheel of gear 26 is coaxially connected to the knee rest 1.

On the axis of the arm 2 and connected to this arm 2 there is situated also the arm 43, which interacts with spring 42 connected to said axis. The rotation of the entire mechanism is blocked by the rotation lock 41.

After releasing the lock 41 the spring 42 via the arm 43 causes rotation of the gear 23 and then the entire mechanism. In such a way the chair is converted to the kneeling-sitting configuration. The lock 41 maintains the mechanism in both configurations.

After releasing the lock 41, the user's hand pressing on the seat will cause rotation of the seat to the horizontal position and via the consecutive gears the movement is transmitted to the arm 2 and the knee rest causing their return to the initial configuration, and simultaneously the arm 43 puts the spring 42 under tension again.

Figure 9:
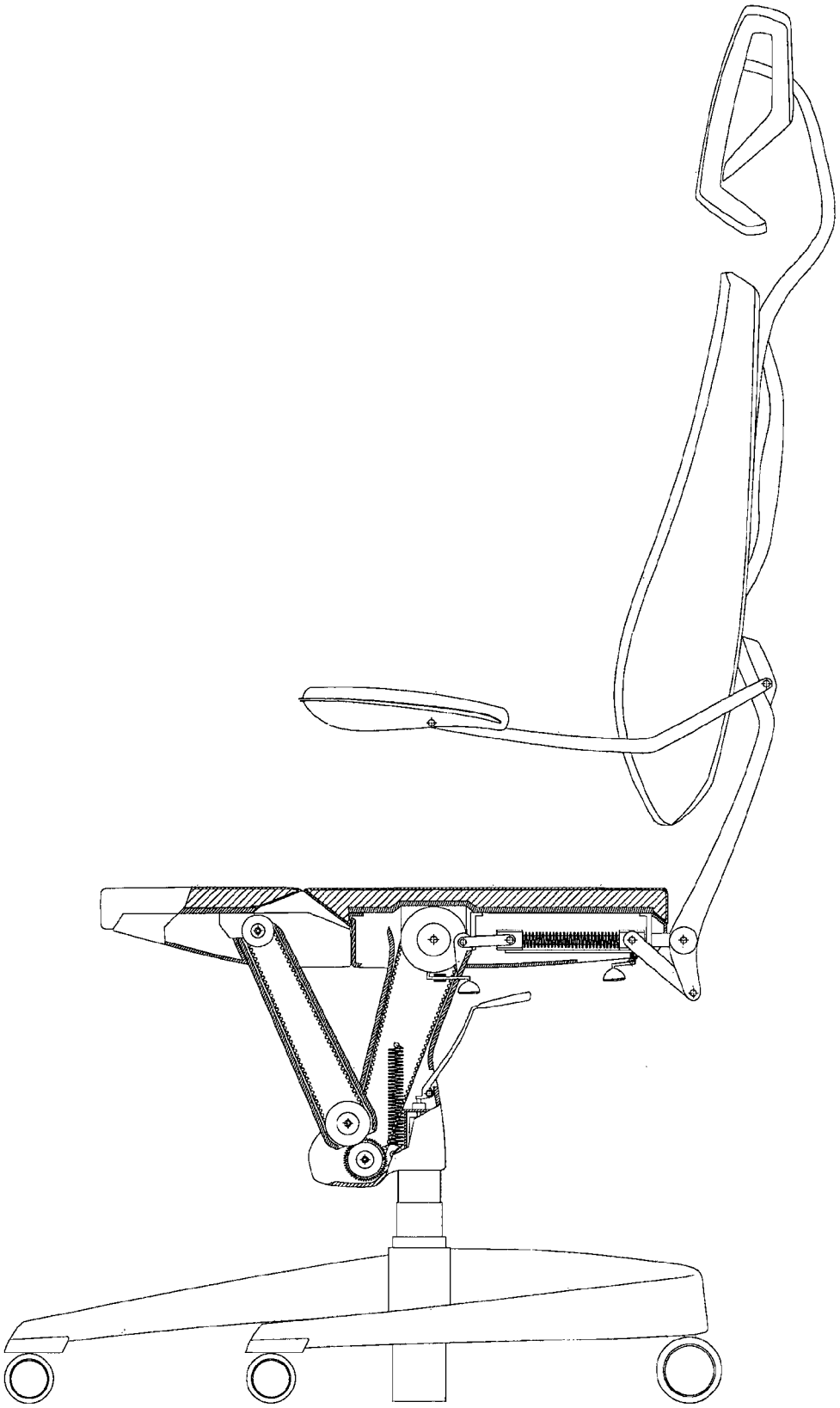
FIG. 9 illustrates the chair with a conversion mechanism based on cogged belt gears and cogged belts in the sitting configuration.
Figure 10:
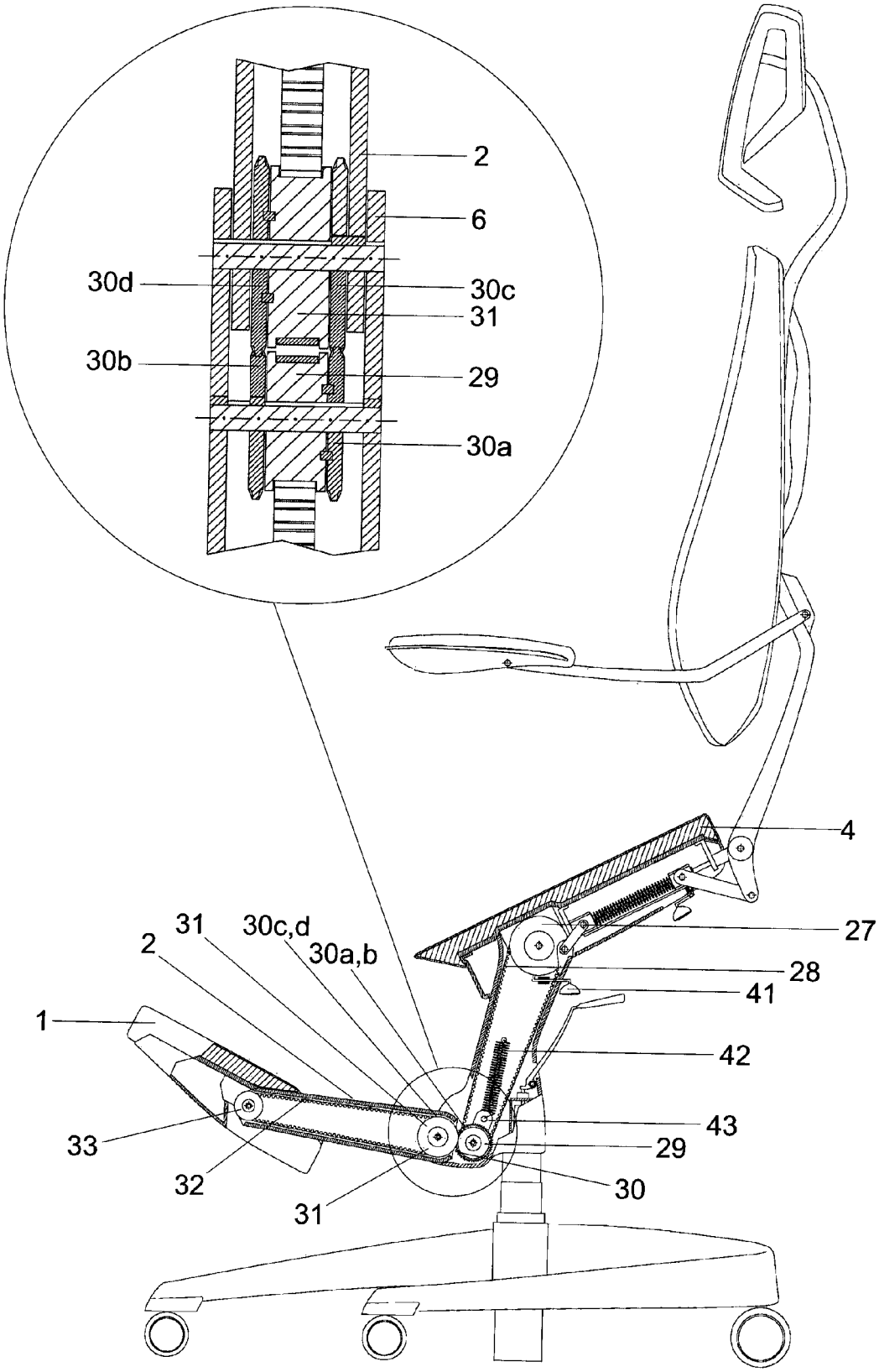
FIG. 10 illustrates the chair with a conversion mechanism based on cogged belt gears and cogged belts in the kneeling configuration.

In the semi-automatic version of the chair with cogged belt gears and cogged belt (FIGS. 9-10) the rear part 4 of the seat is mounted coaxially with a cogged belt wheel 27, which is connected to the cogged belt wheel 29 by means of a cogged belt 28. On a mutual axis with the wheel 29 two cogwheels 30*a* and 30*b* of a double cogged gear 30 are mounted and the first one of the two cogwheels turns along with the wheel 29 while the second one 30*b* is locked on a fixed unmoving axis. While turning, the cogwheel 30*a* turns a cogwheel 30*c* being coaxial with and connected to the arm 2. While turning, the cogwheel 30*c* causes rotation of the arm 2 connected thereto. The cogwheel 30*b* is connected to a non-rotational axis. By blocking a cogwheel 30*d* it causes rotation of the cogwheel 30*d* in relation to the arm 2 at the moment when the arm 2 starts rotating.

On a mutual axis with cogwheel 30*d* there is a cogged belt wheel 31 connected thereto and connected by means of a cogged belt 32 with a cogged belt wheel 33 being coaxial with and connected to the knee rest 1. Coaxially with the wheel 29 and connected thereto there is arranged the arm 43 interacting with the spring 42. After releasing the lock 41 the spring causes rotation of the arm 43 and rotation of the arm causes rotation of the wheels 29 and 30*a*. In turn, rotation of the wheels causes rotation of further mechanisms of wheels, changing the position of the rear part 4 of the seat and of the knee rest 1 into the kneeling-sitting configuration.

Figure 7:
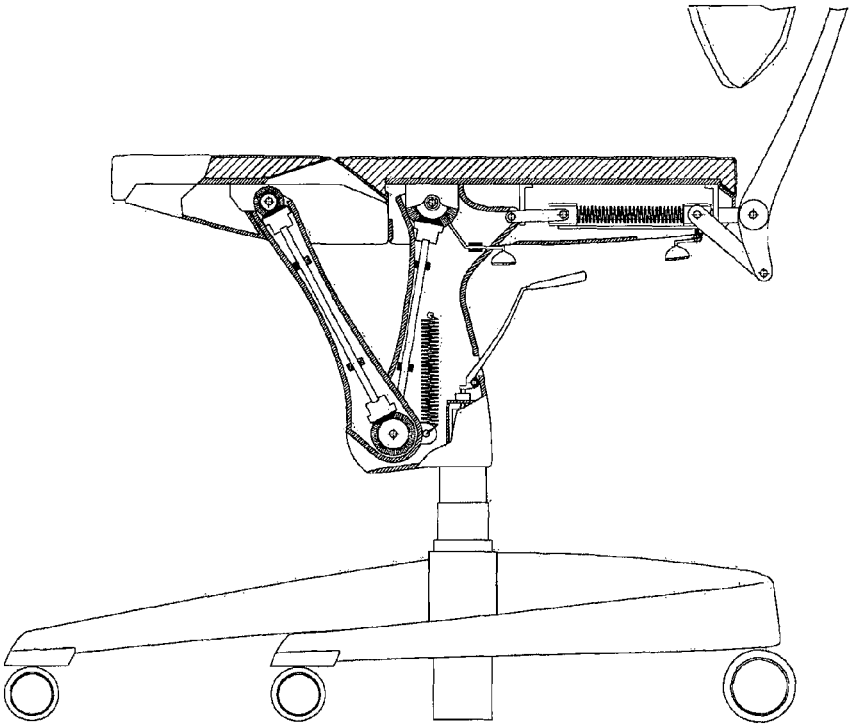
FIG. 7 illustrates the chair with a conversion mechanism based on bevel gears in the sitting configuration.
Figure 8:
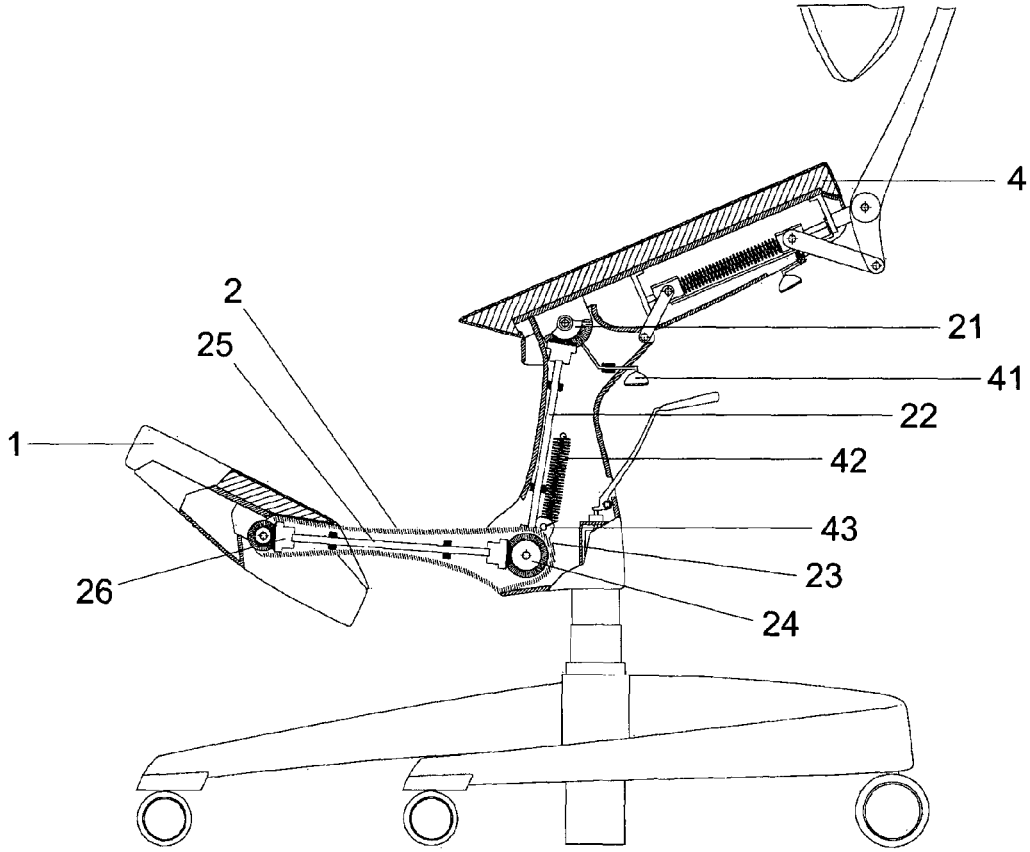
FIG. 8 illustrates the chair with a conversion mechanism based on bevel gears in the kneeling configuration.

As in the embodiment shown on FIGS. 7-8, after releasing the lock 41, the user's hand pressing on the rear part 4 of the seat causes its rotation to the horizontal position and via the consecutive gears the movement is transmitted to the arm 2 and the knee rest 1 causing their return to the initial configuration, and simultaneously the arm 43 puts the spring 42 under tension again. The rotation lock 41 maintains the mechanism in this configuration.

Figure 11:
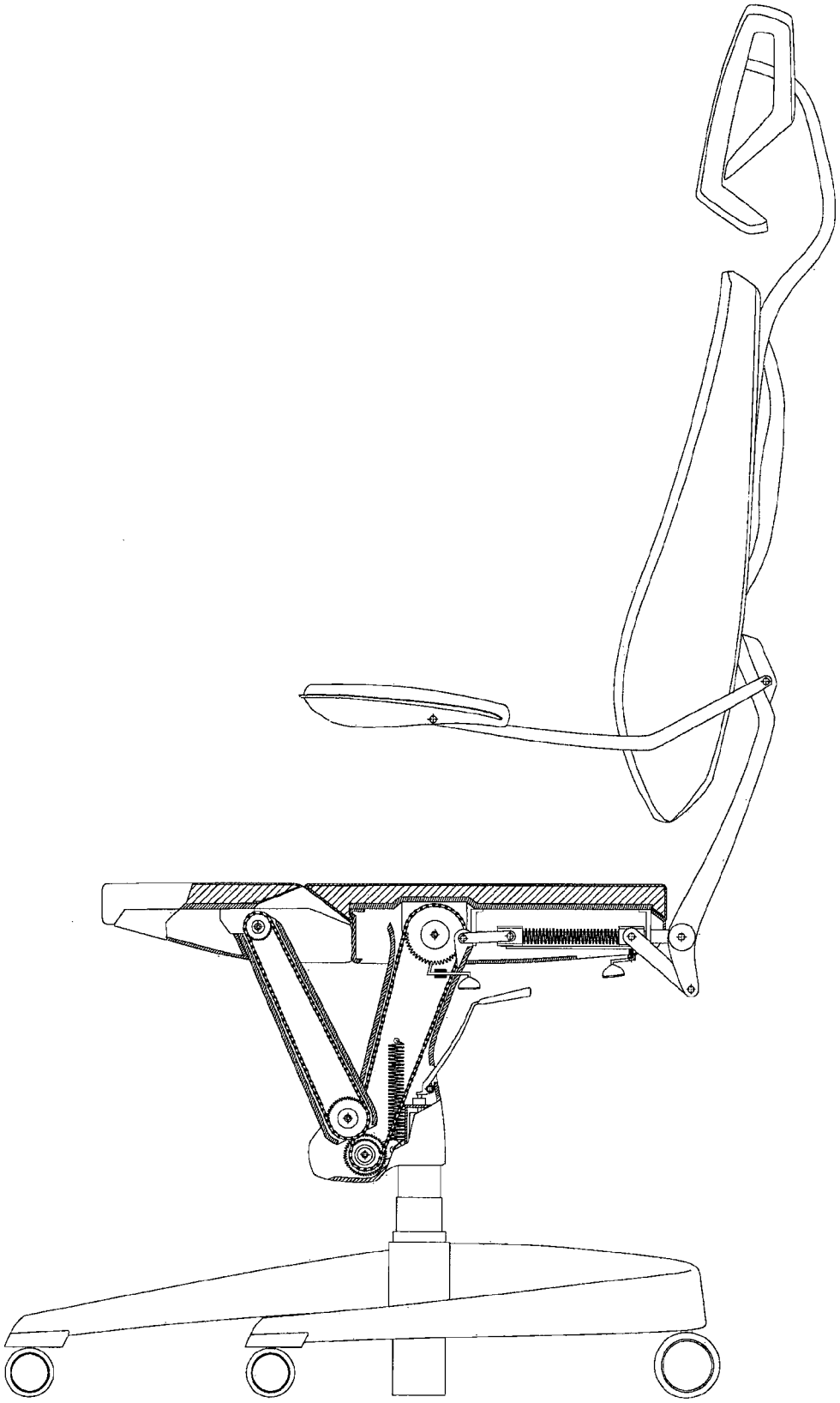
FIG. 11 illustrates the chair with a conversion mechanism based on cogwheels and chains in the sitting configuration.
Figure 12:
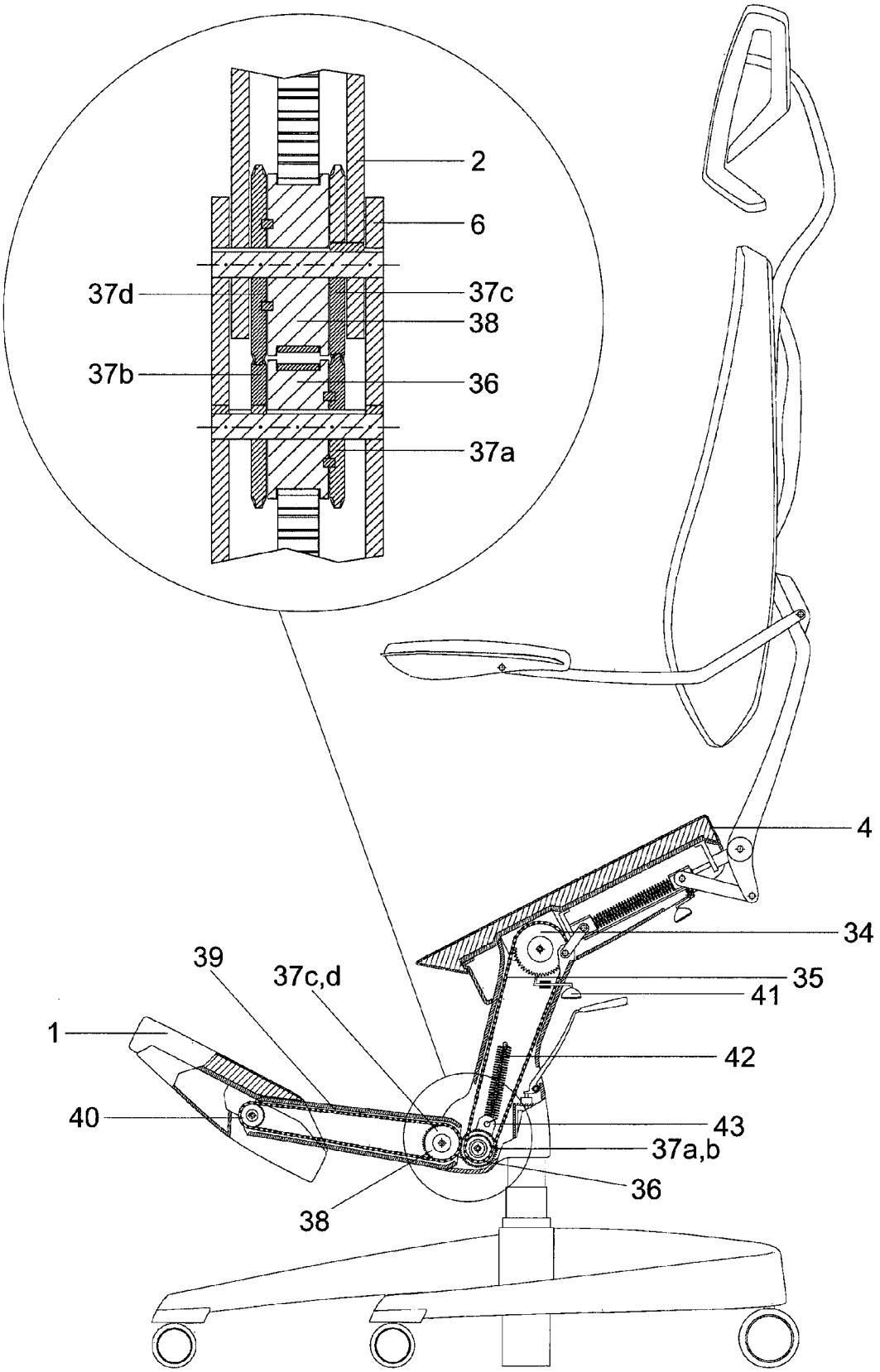
FIG. 12 illustrates the chair with a conversion mechanism based on cogwheels and chains in the kneeling configuration.

In the semi-automatic version of the chair with cogwheels and chains (FIGS. 11-12) the rear part 4 of the seat is mounted coaxially with a cogwheel 34, which is connected to a cogwheel 36 by means of a chain 35. On a mutual axis with the wheel 36 two cogwheels 37*a* and 37*b* of a double cogged gear 37 are arranged and the first one of the two cogwheels turns along with the wheel 36 while the second one 37*b* is locked on a fixed unmoving axis. While turning, the cogwheel 37*a* interacts with a cogwheel 37*c* being coaxial with and connected to the arm 2. While turning, the cogwheel 37*c* causes rotation of the arm 2 connected thereto. The cogwheel 37*b* is connected to a non-rotational axis. By blocking a cogwheel 37*d* it causes rotation of the cogwheel 37*d* in relation to the arm 2 at the moment when the arm 2 starts rotating.

On a mutual axis with the wheel 37*d* there is a cogwheel 38 connected thereto and connected by means of a chain 39 with the cogwheel 40 being coaxial with and connected to the knee rest 1. Coaxially with the wheel 36 and connected thereto there is mounted the arm 43 interacting with the spring 42. After releasing the lock 41 the spring 42 causes rotation of the arm 43 and rotation of the arm causes rotation of the wheels 36 and 37*a*. In turn, rotation of the wheels causes rotation of further mechanisms of wheels, changing the position of the rear part 4 of the seat and of the knee rest 1 into the kneeling-sitting configuration.

After releasing the lock 41, the user's hand pressing on the rear part 4 of the seat causes its rotation to the horizontal position and via the consecutive gears the movement is transmitted to the arm 2 and the knee rest 1 causing their return to the initial configuration, and simultaneously the arm 43 puts the spring 42 under tension again. The rotation lock 41 maintains the mechanism in this configuration.

Figure 13:
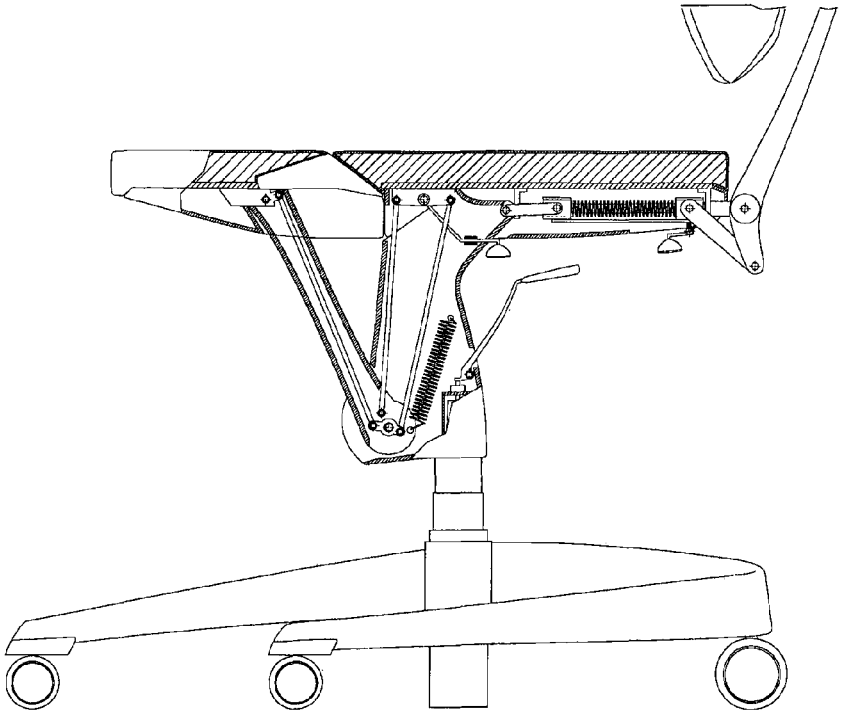
FIG. 13 illustrates the chair with a conversion mechanism based on tie rods in the sitting configuration.
Figure 14:
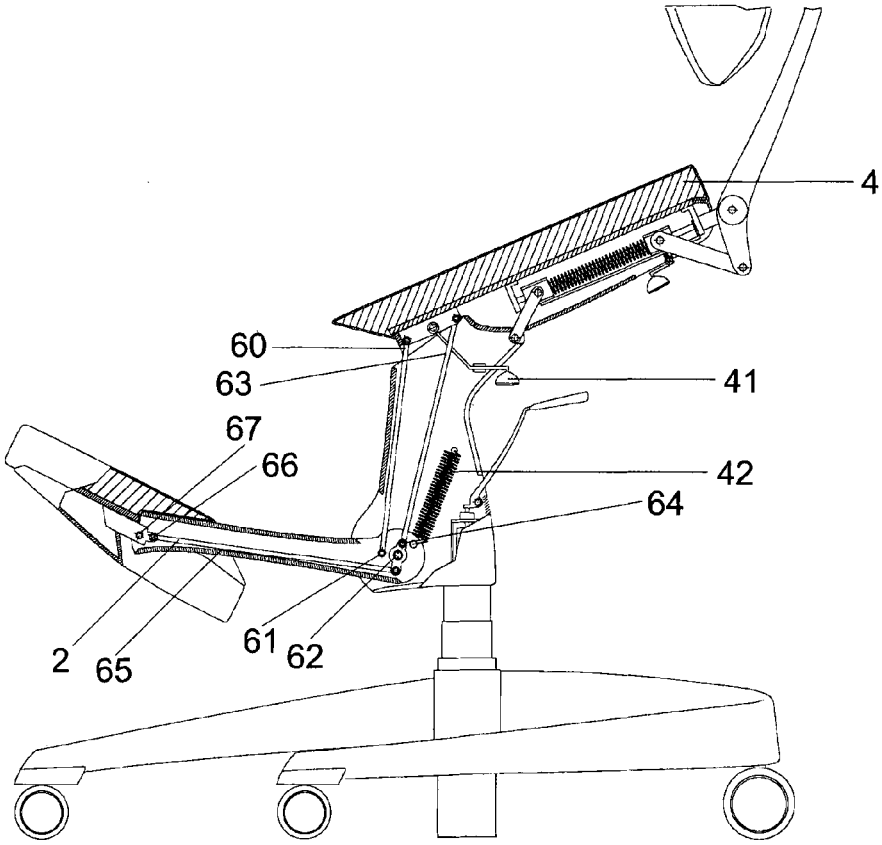
FIG. 14 illustrates the chair with a conversion mechanism based on tie rods in the kneeling configuration.

In the semi-automatic version of the chair with tie rods (FIGS. 13-14) after releasing the rotation lock 41, the rotational movement of the rear part 4 of the seat is transmitted by means of a tie rod 60 and an axis 61 to the arm 2 which will cause its rotation around an axis 62 until it reaches the kneeling configuration. Simultaneously the same rotational movement of the rear pert 4 of the seat 4 causes the movement of a tie rod 63, which is then transmitted to a crank 64. The rotational movement of the crank around the axis causes in turn the movement of a tie rod 65. This tie rod, while causing rotation of the crank 66, causes in turn rotation of the knee rest 1 being coaxial therewith on axis 67 and connected thereto.

The spring 42 forcing the unfolding movement may be replaced in this embodiment by a spring coiled around the axis 62.

Figure 15:
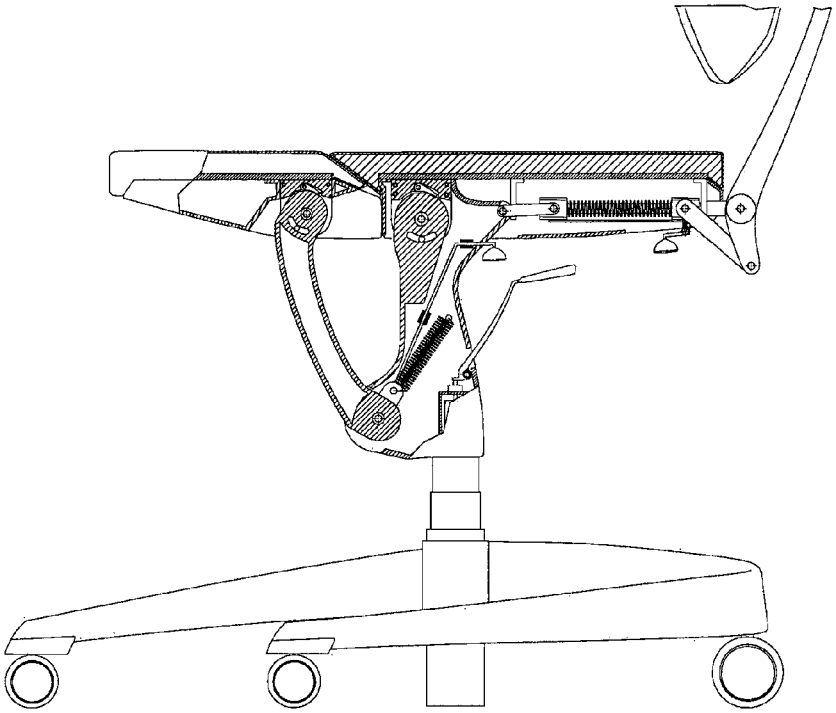
FIG. 15 illustrates the chair with rotation lock and latch blockade mechanisms in the sitting configuration.
Figure 16:
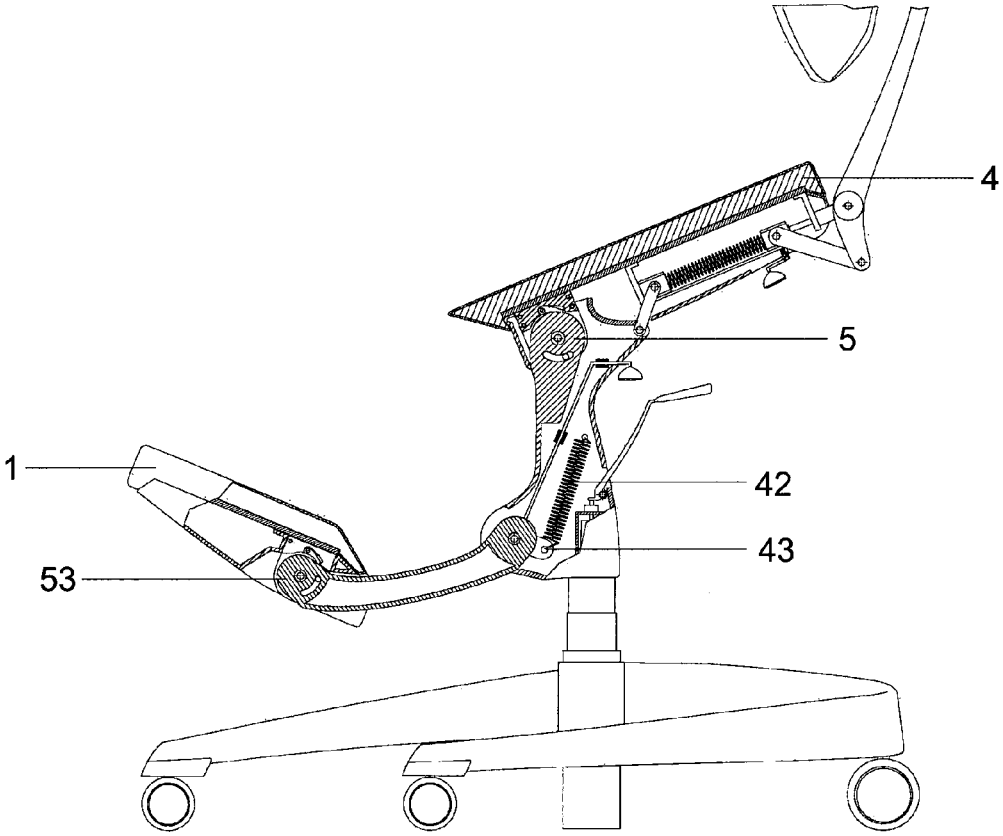
FIG. 16 illustrates the chair with rotation lock and latch blockade mechanisms in the kneeling configuration.

In the basic version of the chair (FIGS. 15-16) a rotational mechanism with rotation lock 5 and 53 may be employed, the mechanism being constructed such (FIG. 18) that a cam 57 is situated coaxially with an arm 54 with a cog and connected to the arm by means of a bolt 56. The rotational movement of the arm 54 is temporarily blocked by a latch 55 which is pressed against the arm 54 by means of a spring 58 and the cam 57 temporarily blocks functioning of the latch 55 by lifting and supporting it. The movement of the arm 54 forces the cam 57 to rotate by means of the bolt 56, which is permanently connected with the arm 54 and moves in a slot 59 in the form of a sector of a ring within the cam 57. The rotation of the cam is forced by the rotating arm 54, when the bolt forcing the rotation reaches the terminal point of the slot 59. When the bolt 56 reaches the terminal point of the slot 59, the arm 54 moving clockwise, pulls the cam 57 and the moving cam 57 lifts the latch 55. Starting from the moment, when the arm 54 moves counter-clockwise the cog of the arm 54 passes below the lifted latch 55, which remains lifted until the bolt reaches the opposite terminal point of the slot 59 and forces the cam to rotate and thus it is removed from below the latch. Repeated counter-clockwise movement of the arm will take place with the unsupported latch pushed by the spring towards the arm, and it will cause the latch to function.

Figure 17:
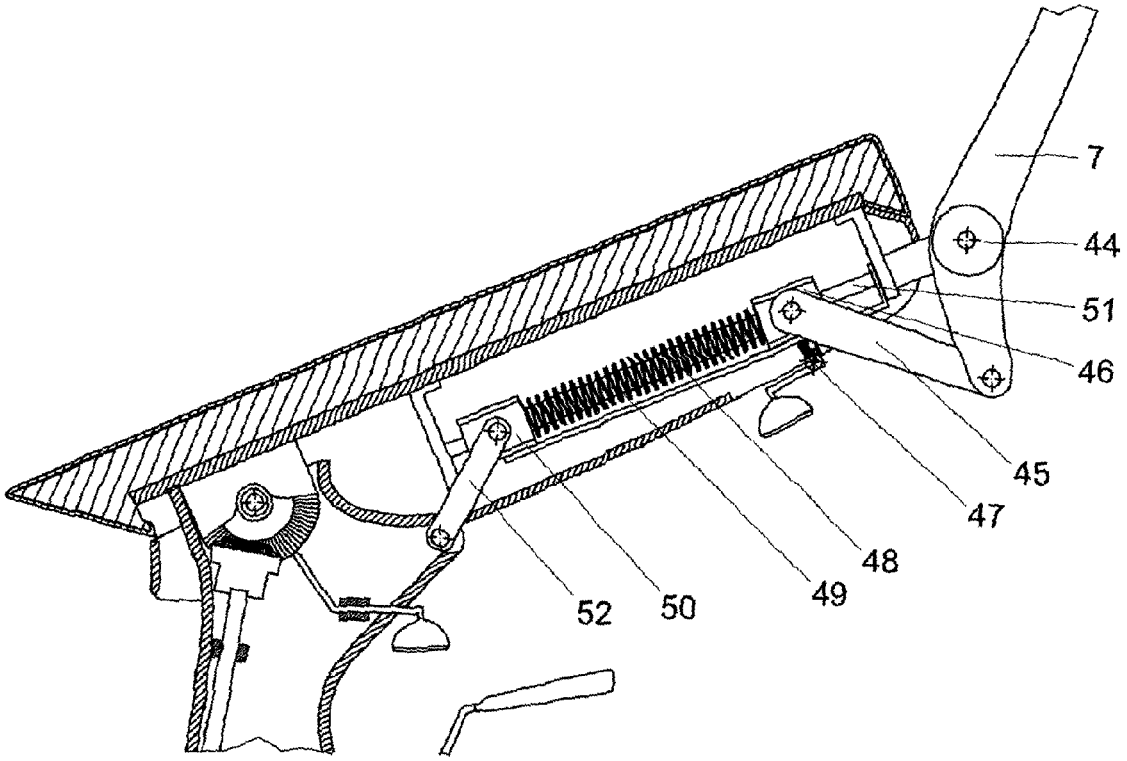
FIG. 17 illustrates the mechanism regulating the inclination angle of the backrest with automatic correction of the inclination angle during conversion.

The chair may be equipped with a mechanism for regulating the angle of inclination of the backrest (FIG. 17) with an automatic correction of the angle during conversion, the mechanism being constructed such that the tie rod 45 is rotationally connected to the backrest support 7 rotating on the axis 44. The tie rod is rotationally mounted on a slider 46 with a slide lock 47. This slider is mounted on a sleeve 48. Together with a spring 49 and an element 50 into which the sleeve 48 is slid permanently, they form the backrest inclination set. This set is slidably mounted on a roller 51 in such a manner that the movement of inclining the rear part 4 of the seat transmitted by means of a tie rod 52 to the element 50 shifts the entire backrest inclination set mounted on the sleeve 48 along the roller 51 and by means of the tie rod 45 corrects the angle of inclination of the backrest support 7. Releasing the slide lock 47 allows for regulating the inclination of the backrest. In such case the slider 46 moves along the sleeve 48 allowing for rotational movement of the backrest support 7. Repeated locking of the lock 47 stops the movement of the backrest in the chosen position.

LIST OF REFERENCE NUMERALS

1. Front part of the seat convertible into an armrest.
2. Front arm of the base of the seat.
3. Rotational mechanism with rotation lock.
4. Rear part of the seat.
5. Rotational mechanism with rotation lock.
6. Rear arm of the base of the seat.
7. Support of the backrest.
8. Plate supporting the rear part of the seat.
9. Set of armrests.
10. Backrest.
11. Support of the headrest.
12. Headrest.
13. Lever of the height regulation mechanism.
14. Column.
15. Wheels of the chair base.
16. Sleeve of the base.
17. Front arm of the base of the chair.
18. Height regulation mechanism.
19. Rear arm of the base of the chair.
20. Rear arm of the base of the chair.
21. Bevel gear.
22. Roller.
23. Bevel gear.
24. Bevel gear.
25. Roller.
26. Transmission.
27. Cogged belt wheel.
28. Cogged belt.
29. Cogwheel.
30. Double cogged gear.
30*a-d*. Cogwheels of the double cogged gear 30.
31. Cogged belt wheel.
32. Cogged belt.
33. Cogged belt wheel.
34. Cogwheel.
35. Chain.
36. Cogwheel.
37. Double cogged gear.
37*a-d*. Cogwheels of the double cogged gear 37.
38. Cogwheel.
39. Chain.
40. Cogwheel.
41. Lock.
42. Spring.
43. Arm.
44. Rotation axis.
45. Tie rod.
46. Slider.
47. Slide lock.
48. Sleeve.
49. Spring.
50. Sleeve mounting element.
51. Roller.
52. Tie rod.
53. Rotation lock.
54. Arm with cog.
55. Latch.
56. Bolt.
57. Cam.
58. Spring.
59. Slot in the form of a section of a ring.
60. Tie rod.
61. Axis.
62. Rotation axis.
63. Tie rod.
64. Crank.
65. Tie rod.
66. Crank.
67. Rotation axis.

The invention claimed is:

1. A dual functional chair to be used in a sitting and a kneeling-sitting configuration comprising:

a dividable seat, wherein the dividable seat comprises:

a front part, wherein the front part is convertible into a knee rest;

a base, wherein the base includes a movable front arm;

wherein the front part is rotationally operatively connected to the movable front arm;

a first rotator, wherein the movable front arm rotates on an axis of the first rotator;

a rear part, wherein the rear part has a variable angle of inclination, wherein the rear part has a top surface;

a rear arm;

a second rotator, wherein the rear part is operatively connected to the rear arm by the second rotator; and wherein the front part of the seat has a to surface that is flush with the top surface of the rear part of the seat when the seat is in a horizontal position for allowing a user to sit upon the seat in the sitting configuration.

2. The chair according to claim 1, further comprising:

a chair base, wherein the chair base includes a front bottom arm and two rear bottom arms;

a column, wherein the column includes a sleeve; and five wheels, wherein the chair base is configured such that the sleeve is supported on the front bottom arm and the two rear bottom arms, wherein the front bottom arm and the two rear bottom arms are supported on the five wheels, wherein the five wheels are arranged on a circle and spaced apart from each other at an angle of 72°, wherein the front bottom arm is supported on one wheel and each of the rear bottom arms is supported on two wheels.

3. The chair according to claim 1, further comprising:

a first bevel gear;

a second bevel gear;

a third bevel gear; and first and second rollers, wherein a rotational movement of the front part of the seat may be transmitted by the first bevel gear by the first roller to the second bevel gear forcing the rotational movement of the front arm, wherein movement of the second bevel gear forces movement of the second roller by the third bevel gear placed coaxially on a same mutual axis with the second bevel gear, wherein movement of the second roller forces rotational movement of the third bevel gear that changes while turning a position of the front part of the seat giving the front part a function of the knee rest.

4. The chair according to claim 1 further comprising:

first and second cogged belt wheels;

a first cogwheel;

a double cogged gear, wherein the double cogged gear includes second and third cogwheels;

fourth and fifth cogwheels;

first and second cogged belts;

consecutive gears;

a third arm;

a lock; and a spring, wherein movement of the front part of the seat may be transmitted to the first cogged belt wheel, which by the first cogged belt transmits rotational movement to the first cogwheel, wherein the second and third cogwheels of the double cogged gear are placed on a mutual axis with the first cogwheel, wherein the second cogwheel turns along with the first cogwheel while the third cogwheel is blocked on a fixed unmoving axis, wherein while turning, the second cogwheel turns a fourth cogwheel which is coaxial with and operatively connected to the front arm, wherein while turning, the fourth cogwheel causes rotation of the front arm, wherein the third cogwheel is operatively connected to a fixed unmoving axis while blocking the fifth cogwheel, wherein the third cogwheel causes rotation of the fifth cogwheel in relation to the front arm at a moment, when the front arm starts rotating, wherein simultaneously, the second cogged belt wheel is operatively connected to the fifth cogwheel and rotates coaxially therewith and transmits the movement by the second cogged belt to the second cogged belt wheel turning coaxially with the knee rest, wherein the third arm is arranged coaxially with and operatively connected to the first cogwheel and the spring interacts with the third arm, wherein when the lock is in a released configuration, the seat rotates upon pressing to a horizontal position and movement of the seat is transmitted by the consecutive gears to the front arm and the knee rest causing the front arm and the knee rest to return to an initial configuration, wherein at the same time, the third arm puts the spring under tension again and the lock maintains the front arm and the knee rest in the initial configuration.

5. The chair according to claim 1, further comprising:

a cogged belt wheel;

first and second cogwheels;

a double cogged gear, wherein the double cogged gear includes third and fourth cogwheels;

fifth and sixth cogwheels;

a wheel;

a third arm;

first and second chains;

consecutive gears;

a lock; and a spring, wherein movement of the rear part of the seat may be transmitted to the first cogwheel which, by the first chain, transmits rotational movement of the first cogwheel to a second cogwheel, wherein the third and fourth cogwheels of the double cogged gear are arranged on a mutual axis with the second cogwheel, wherein the third cogwheel turns along with the second cogwheel while the fourth cogwheel is blocked on a fixed unmoving axis, wherein, while turning, the third cogwheel turns the fifth cogwheel, wherein the fifth cogwheel is coaxial with and operatively connected to the front arm, wherein, while turning, the fifth cogwheel causes rotation of the front arm operatively connected therewith, wherein the fourth cogwheel is operatively connected to a non-rotational axis, and while blocking the wheel, the fourth cogwheel causes rotation of the wheel in relation to the front arm at a moment when the front arm starts rotating, wherein the cogged belt wheel is operatively connected to the wheel and turns coaxially with the wheel and transmits movement of the cogged belt wheel by the second chain to the sixth cogwheel turning coaxially with the knee rest, wherein the third arm is arranged coaxially with and operatively connected to the wheel, wherein the spring interacts with the third arm, wherein when the lock is in a released position, the rear part of the seat rotates upon pressing to the horizontal position and movement of the seat is transmitted by the consecutive gears to the front arm and the knee rest causing the front arm and the knee rest to return to an initial configuration, wherein, at the same time, the third arm puts the spring under tension again and the lock maintains the front arm and the knee rest in the initial configuration.

6. The chair according to claim 1, further comprising:

a slow-speed electrical engine; and at least one of a gear and a roller;

wherein the slow-speed electrical engine is attached to one of the gear and the roller, wherein the slow-speed electrical engine forces movement causing unfolding and folding of the chair.

7. The chair according to claim 1, further comprising:

a lock;

first and second tie rods; and first and second cranks, wherein when the lock is in a released configuration, rotational movement of the rear part of the seat is transmitted by the tie rod and a first axis to the moveable front arm and causes rotation on a second axis, wherein at the same time, rotational movement of the rear part of the seat is transmitted by movement of the first tie rod to the first crank, wherein rotational movement of the first crank is subsequently transmitted to movement of the second tie rod that while causing rotation of the second crank around a third axis also causes rotation of the knee rest being coaxial with and operatively connected to the second crank.

8. The chair according to claim 1, further comprising:

a regulator;

a backrest;

a support, wherein the support supports the backrest;

first and second tie rods;

a slider;

a slide lock;

a sleeve;

a spring;

an element; and a roller, wherein the regulator regulates an angle of inclination of the backrest with an automatic correction of the angle of inclination of the backrest during conversion of the chair into a kneeling-sitting configuration, wherein the regulator operates in such a manner that a position of the support of the backrest rotating on an axis is determined by the first tie rod rotationally operatively mounted to the support of the backrest, wherein the first tie rod is rotationally operatively connected to the slider with the slide lock, and the slider is in turn slidably operatively mounted on the sleeve, that together with the spring and the element into which the sleeve is slid permanently, form a backrest inclination set, wherein the backrest inclination set is slidably arranged on the roller in such a manner that an inclining movement of the rear part of the seat is transmitted by the second tie rod to the element, which shifts the entire backrest inclination set for inclination of the backrest operatively mounted on the sleeve along the roller, wherein the first tie rod corrects an angle of inclination of the support for the backrest.

9. The chair according to claim 1, further comprising:

a rotator, wherein the rotator includes a rotation lock;

a cam;

a third arm, wherein the third arm includes a cog;

a bolt;

a latch;

spring;

wheel; and slot, wherein the rotator with the rotation lock may be constructed such that the cam is arranged coaxially with the third arm with the cog and operatively connected to the third arm by the bolt, wherein movement of the arm may be blocked by a latch, wherein the cam may temporarily block functioning of the latch by lifting and supporting the latch, wherein the latch is pressed against the arm by the spring, wherein the wheel forces rotation of the cam by the bolt which is permanently operatively connected to the wheel, and moves in the slot in the form of a sector of a ring within the cam, wherein rotation of the cam is forced by the turning of the wheel when the bolt forcing the rotation reaches the terminal point of the slot, wherein the wheel moving clockwise pulls the cam when the bolt reaches the terminal point of the slot, while in turn the cam lifts the latch, wherein starting from a moment when the wheel moves counter-clockwise, the cog passes below the lifted latch which remains lifted until the bolt reaches the opposite terminal point of the slot and forces rotation of the cam causing removal of the cam from below the latch, wherein repeated counter-clockwise movement of the arm will take place with the unsupported latch pushed by the spring towards the arm and the arm will cause the latch to function.

10. A dual functional chair to be used in a sitting and a kneeling-sitting configuration comprising:

a dividable seat, wherein the dividable seat comprises:

a front part, wherein the front part is convertible into a knee rest;

a base;

wherein the front part is operatively connected to the base and movable relative to the base from an initial configuration for allowing a user to sit upon the front part, to a kneel-sitting configuration, wherein the front part is horizontal when in the initial configuration;

a rear part, wherein the rear part has a sitting configuration for allowing a user to sit upon the rear part, wherein the rear part is horizontal when in the sitting configuration, wherein the rear part has a top surface;

wherein the front part of the seat has a top surface that is flush with the top surface of the rear part of the seat when the front part is horizontal in the initial configuration and the rear part is horizontal in the sitting configuration, wherein the front part is convertible into a knee rest of the seat when the front part is in the kneel-sitting configuration.

11. The chair according to claim 10, wherein the rear part is operatively connected to the base and movable relative to the base, and has a variable angle of inclination.

12. The chair according to claim 10, further comprising:

a chair base, wherein the chair base includes a front bottom arm and two rear bottom arms;

a column, wherein the column includes a sleeve; and five wheels, wherein the chair base is configured such that the sleeve is supported on the front bottom arm and the two rear bottom arms, wherein the front bottom arm and the two rear bottom arms are supported on the five wheels, wherein the five wheels are arranged on a circle and spaced apart from each other at an angle of 72°, wherein the front bottom arm is supported on one wheel and each of the rear bottom arms is supported on two wheels.

13. The chair according to claim 10, further comprising:

a first bevel gear;

a second bevel gear;

a third bevel gear; and first and second rollers, wherein the base includes a movable front arm, wherein the front part is rotationally operatively connected to the movable front arm, wherein a rotational movement of the front part of the seat may be transmitted by the first bevel gear by the first roller to the second bevel gear forcing the rotational movement of the front arm, wherein movement of the second bevel gear forces movement of the second roller by the third bevel gear placed coaxially on a same mutual axis with the second bevel gear, wherein movement of the second roller forces rotational movement of the third bevel gear that changes while turning a position of the front part of the seat giving the front part a function of the knee rest.

14. The chair according to claim 10, wherein the base includes a movable front arm, wherein the front part is rotationally operatively connected to the movable front arm, wherein the chair further comprises:

first and second cogged belt wheels;

a first cogwheel;

a double cogged gear, wherein the double cogged gear includes second and third cogwheels;

fourth and fifth cogwheels;

first and second cogged belts;

consecutive gears;

a second arm;

a lock; and a spring, wherein movement of the front part of the seat may be transmitted to the first cogged belt wheel, which by the first cogged belt transmits rotational movement to the first cogwheel, wherein the second and third cogwheels of the double cogged gear are placed on a mutual axis with the first cogwheel, wherein the second cogwheel turns along with the first cogwheel while the third cogwheel is blocked on a fixed unmoving axis, wherein while turning, the second cogwheel turns a fourth cogwheel which is coaxial with and operatively connected to the front arm, wherein while turning, the fourth cogwheel causes rotation of the front arm, wherein the third cogwheel is operatively connected to a fixed unmoving axis while blocking the fifth wheel, causes rotation of the fifth cogwheel in relation to the front arm at a moment, when the front arm starts rotating, wherein simultaneously, the second cogged belt wheel is operatively connected to the fifth cogwheel and rotates coaxially therewith and transmits the movement by the second cogged belt to the second cogged belt wheel turning coaxially with the knee rest, wherein the second arm is arranged coaxially with and operatively connected to the first cogwheel, wherein the spring interacts with the second arm, wherein when the lock is in a released configuration, the seat rotates upon pressing to a horizontal position and movement of the seat is transmitted by the consecutive gears to the front arm and the knee rest causing the knee rest to return to the initial configuration, wherein at the same time, the second arm puts the spring under tension again and the lock maintains the knee rest in the initial configuration.

15. The chair according to claim 10, wherein the base includes a movable front arm, wherein the front part is rotationally operatively connected to the movable front arm, wherein the chair further comprises:

a cogged belt wheel;

first and second cogwheels;

a double cogged gear, wherein the double cogged gear includes third and fourth cogwheels;

fifth and sixth cogwheels;

a wheel;

a second arm;

first and second chains;

consecutive gears;

a lock; and a spring, wherein movement of the rear part of the seat may be transmitted to the first cogwheel which, by the first chain, transmits rotational movement of the first cogwheel to a second cogwheel, wherein the third and fourth cogwheels of the double cogged gear are arranged on a mutual axis with the second cogwheel, wherein the third cogwheel turns along with the second cogwheel while the fourth cogwheel is blocked on a fixed unmoving axis, wherein, while turning, the third cogwheel turns the fifth cogwheel, wherein the fifth cogwheel is coaxial with and operatively connected to the front arm, wherein, while turning, the fifth cogwheel causes rotation of the front arm operatively connected therewith, wherein the fourth cogwheel is operatively connected to a non-rotational axis, and while blocking the wheel, the fourth cogwheel causes rotation of the wheel in relation to the front arm at a moment when the front arm starts rotating, wherein the cogged belt wheel is operatively connected to the wheel and turns coaxially with the wheel and transmits movement of the cogged belt wheel by the second chain to the sixth cogwheel turning coaxially with the knee rest, wherein the second arm is arranged coaxially with and operatively connected to the wheel, wherein the spring interacts with the second arm, wherein when the lock is in a release configuration, the rear part of the seat rotates upon pressing to the sitting configuration and movement of the seat is transmitted by the consecutive gears to the front arm and the knee rest causing the knee rest to return to the initial configuration, wherein, at the same time, the second arm puts the spring under tension again and the lock maintains the knee rest in the initial configuration.

16. The chair according to claim 10, further comprising:

a slow-speed electrical engine; and at least one of a gear and a roller;

wherein the slow-speed electrical engine is attached to one of the gear and the roller, wherein the slow-speed electrical engine forces movement causing unfolding and folding of the chair.

17. The chair according to claim 10, wherein the base includes a movable front arm, wherein the front part is rotationally operatively connected to the movable front arm, wherein the chair further comprises:

a lock;

first and second tie rods; and first and second cranks, wherein when the lock is in a release configuration, rotational movement of the rear part of the seat is transmitted by the tie rod and a first axis to the moveable front arm and causes rotation on a second axis, wherein at the same time, rotational movement of the rear part of the seat is transmitted by movement of the first tie rod to the first crank, wherein rotational movement of the first crank is subsequently transmitted to movement of the second tie rod that while causing rotation of the second crank around a third axis also causes rotation of the knee rest being coaxial with and operatively connected to the second crank.

18. The chair according to claim 10, further comprising:

a regulator;

a backrest;

a support, wherein the support supports the backrest;

first and second tie rods;

a slider;

a slide lock;

a sleeve;

a spring;

an element; and a roller, wherein the regulator regulates an angle of inclination of the backrest with an automatic correction of the angle of inclination of the backrest during conversion of the chair into a kneeling-sitting configuration, wherein the regulator operates in such a manner that a position of the support of the backrest rotating on an axis is determined by the first tie rod rotationally operatively mounted to the support of the backrest, wherein the first tie rod is rotationally operatively connected to the slider with the slide lock and the slider is in turn slidably operatively mounted on the sleeve, that together with the spring and the element into which the sleeve is slid permanently, form a backrest inclination set, wherein the back rest inclination set is slidably arranged on the roller in such a manner that an inclining movement of the rear part of the seat being transmitted by the second tie rod to the element, shifts the entire backrest inclination set for inclination of the backrest operatively mounted on the sleeve along the roller, wherein the first tie rod corrects an angle of inclination of the support for the backrest.

19. The chair according to claim 10, further comprising:

a rotator, wherein the rotator includes a rotation lock;

a cam;

an arm, wherein the third arm includes a cog;

a bolt;

a latch;

spring;

wheel; and slot, wherein the rotator with the rotation lock may be constructed such that the cam is arranged coaxially with the arm with the cog and operatively connected to the arm by the bolt, wherein movement of the arm may be blocked by a latch, wherein the cam may temporarily block functioning of the latch by lifting and supporting the latch, wherein the latch is pressed against the arm by the spring, wherein the wheel forces rotation of the cam by the bolt which is permanently operatively connected to the wheel, and moves in the slot in the form of a sector of a ring within the cam, wherein rotation of the cam is forced by the turning of the wheel when the bolt forcing the rotation reaches the terminal point of the slot, wherein the wheel moving clockwise pulls the cam when the bolt reaches the terminal point of the slot, while in turn the cam lifts the latch, wherein starting from a moment when the wheel moves counter-clockwise, the cog passes below the lifted latch which remains lifted until the bolt reaches the opposite terminal point of the slot and forces rotation of the cam causing removal of the cam from below the latch, wherein repeated counter-clockwise movement of the arm will take place with the unsupported latch pushed by the spring towards the arm and the arm will cause the latch to function.

* * * * *